United States Patent [19]

Biddulph et al.

[11] Patent Number: 4,755,824

[45] Date of Patent: Jul. 5, 1988

[54] HARDENED COUPLING DEVICE AND METHOD

[75] Inventors: Stuart Biddulph; Ferril A. Losee, both of Provo, Utah

[73] Assignee: Eyring Research Institute, Inc., Provo, Utah

[21] Appl. No.: 566,422

[22] Filed: Dec. 23, 1983

[51] Int. Cl.[4] ..... H01Q 1/04

[52] U.S. Cl. ..... 343/719; 174/50

[58] Field of Search ..... 174/50; 343/821, 822, 343/852, 853, 859, 860, 865, 872, 719; 333/12, 25, 32, 243; 339/93 R, 143 R, 9 A, 6 R; 336/90

[56] References Cited

U.S. PATENT DOCUMENTS

| | | | |
|---|---|---|---|
| 2,753,533 | 7/1956 | Houser | 174/50 |
| 3,404,404 | 10/1968 | Theakston | 343/821 |
| 4,017,863 | 4/1977 | Tharp et al. | 343/719 |
| 4,088,998 | 5/1978 | Rawls | 343/719 |

*Primary Examiner*—Thomas H. Tarcza
*Assistant Examiner*—Ian J. Lobo
*Attorney, Agent, or Firm*—Workman, Nydegger & Jensen

[57] ABSTRACT

An impact-hardened coupling device and method for matching the impedance of two or more separate electrical elements such as found in an antenna assembly, and for securing and maintaining the electrical elements in impact-hardened electrical contact. Electrical conductors are mounted in a terminal in slideably electrical contact. The electrical conductors are configurated so that their effective impedance substantially matches the line-to-line impedance of a transmission line in turn connected to a transceiver or like equipment. An electrical surge arrester is provided to protect the conductors and the interconnected electrical elements from high loading situations occurring in response to exposure to electromagnetic pulse radiation. The terminals are potted with a resinous material to provide impact protection to the components of the device while continuing to maintain electrical contact between the conductors.

30 Claims, 3 Drawing Sheets

HARDENED COUPLING DEVICE AND METHOD

BACKGROUND

1. Field of the Invention

The present invention relates to devices for coupling electrical systems or devices together, and for balancing the impedances between the coupled systems or devices, and in particular to a blast hardened apparatus for matching the impedance of and producing a blast-hardened connection between two or more electrical elements.

2. The Prior Art

Circuits or devices for matching impedance in electrical systems are well known in the art. The importance of such impedance matching lies mainly in the fact that the matching of impedance allows optimum undistorted energy transfer between the connected electrical elements.

Devices for matching impedances often accomplish several purposes as part of their function, including: providing a physical connection between systems or devices; providing balanced impedance between those connected systems or devices; and, in some instances, providing shielding for the conductions and/or other protection for the systems by means of interconnected devices such as surge arresters.

One particular type of device which is often used for impedance matching is a balance to unbalance transformer (balun) which provides impedance matching in addition to balance-to-unbalance transformer coupling. Typically, a balun is a passive device having distributed electrical constants used to couple a balanced system or device to an unbalanced system or device, in addition to matching the impedances of the connected elements. The baluns generally comprise a ferrite core with multiple conductor windings positioned thereon.

The baluns and other devices and methods which are often utilized for impedance matching have generally been found to perform satisfactorily in conventional applications under normal operating conditions. However, such devices and methods have generally been considered "soft" for security purposes and have been unacceptable for applications involving operation under the force impact conditions for example due to explosion or natural disaster. "Hardness"(or "softness") is a military term used to denote the system's vulnerability to destruction. The harder a system is, the less vulnerable to destruction it is.

The hardness of an electrical system is often measured by such criteria as its ability to withstand substantial shock, as in the case of a powerful explosion occurring very near to the system, and its ability to survive high energy electromagnetic pulse radiation such as that which may be produced by a nuclear blast.

When devices for matching impedance are utilized in systems which are exposed to conditions such as those produced by nearby explosions, they are often exposed to extreme forces which have such destructive power that the devices may be destroyed or rendered unable to properly function. For example, when a balun having a ferrite core is exposed to a nearby, high powered blast, the resulting shock waves typically cause the core to shatter. Furthermore, if such systems are not provided with means for protecting them from voltage and/or current surges, exposure of the device and/or the systems to a nuclear explosion will likely disable the system since the electromagnetic pulse radiation produced by the explosion may induce an overload current in the conductors.

Conditions are even worse in situations where the device for matching impedances is utilized upon or beneath the surface of the earth. Particular applications that may require the impedance matching device to be positioned upon or beneath the surface of the earth include underground telephone or communication systems. These types of systems, of course, necessarily must be maintained in operating condition during times of natural disaster or enemy attack, when the probability of exposure to extreme forces is the highest. Particular embodiments of communication systems utilized upon or beneath the surface of the earth are described in the copending patent applications of Ferril A. Losee, U.S. Ser. Nos. 393,043 now allowed and 393,044 now allowed, each filed on June 23, 1982, and entitled, respectively, "Wireless Communication System Using Current Formed Underground Vertical Plane Polarized Antennas" and "Low Profile Wireless Communication System and Method", both of which are incorporated herein by reference.

The use of an impedance matching device is of particular importance in the communication systems described in the above-referenced applications. Specifically, in those systems, when the impedance of the earth and the current driver described therein are approximately matched (by means of an impedance matching device) to the impedance of a signal source, then ground currents are induced into the earth which, if correctly sized, define a loop of sufficient size to cause the earth and the current driver to essentially function together as a vertical plane polarized antenna. The absence of an impedance matching device would clearly hamper the ability to properly operate those systems.

Preferably, the impedance matching device in such systems is positioned, along with the systems elements, upon or beneath the surface of the earth. In such applications, the impedance matching device is necessarily subject to any movements or other actions of the surrounding earth. For example, when a large explosion occurs, it produces shock waves which travel throughout the surrounding environment including the air, earth and water. As the shock waves travel through the earth, they produce a substantial displacement of the ground, which responds in a manner similar to a fluid material. Thus, the earth is actually caused to rise and fall in a wave action, with the wave amplitude being from several inches to several feet, depending upon the size and location of the blast or other force which initiated the shock waves.

Baluns and similar devices which are often used for impedance matching purposes in conventional applications typically cannot withstand the extreme forces associated with the displacement of the earth by traveling shock waves, as described above. These devices typically secure the systems or devices to be interconnected by rigidly fastening the conductors associated with those systems that the conductors are tightly and securely held within the impedance matching device.

However, under the conditions associated with the traveling shock waves, the displacement of the earth often causes the securely fastened and rigidly held conductors to pull free or break. Thus, even though a powerful explosion may be centered some distance from the underground communication system, the resulting shock waves may likely result in breakage or separation of the conventional, tightly secured electrical connection. Of course, these types of ground conditions can also be associated with earthquakes and other similar natural phenomena, with the same, unacceptable results.

It is extremely important that communication systems such as those referenced above, as well as many other types of important electrical systems, be constructed so as to be able to withstand the excessive forces which may occur during natural disasters or as a result of enemy attack. Protection needs to be provided both to prevent the damaging effects resulting from the shock waves or displacement of the earth, and to prevent damage to electrical systems which may result from exposure to large amounts of electromagnetic pulse radiation produced by nuclear blasts.

It is under conditions such as these when the proper functioning of communication systems and similar important electronic equipment (which require impedance matching devices) is of utmost importance not only for local emergency purposes, but also to possibly preserve the national security. Nevertheless, a blast-hardened impedance matching device which provides the protection described above has not been made available and, thus, the problem continues to exist.

As is apparent from the above discussion, what is needed in the art is a blast-hardened device and method for matching the impedance of two or more systems or devices which are to be connected. A further improvement in the art would be to provide such an apparatus and method which additionally provides for blast-hardened connections between the systems and devices so that continuous electrical contact is maintained, even during the presence of extreme forces. Still a further improvement in the art would be to provide such a system which also includes a means for protecting the connected systems or devices from exposure to high amounts of electromagnetic pulse radiation. Yet another improvement in the art would be to provide such an apparatus and method which would include a means whereby a multiplicity of systems or devices could be electrically connected. Such an apparatus and method is disclosed and claimed herein.

BRIEF SUMMARY AND OBJECTS OF THE INVENTION

The present invention comprises a novel, blast-hardened apparatus and method for matching the impedances of multiple separate systems or devices, and for securing and maintaining the systems or devices in blast-hardened electrical contact. The apparatus includes a housing which confines electrically conductive receivers each of which in turn secures at least one electrical conductor in slideable electrical contact. An electrical surge arrester is positioned to electrically connect each of the receivers in order to provide for surge protection in high amperage situations such as may result from exposure to large amounts of electromagnetic pulse radiation.

Positioned in alignment with the receivers, are two coaxial cable connectors. Each coaxial cable connector secures the outer conductor (ground connector) of a coaxial cable which is associated with an electrical element such as a transmitter/receiver. Electrical contact between the inner coaxial conductors and the receivers is maintained along the elongated chamber walls so that the conductor may slide within the chamber of the receiver in response to external forces, without loss of electrical contact.

The impedances of the electrical elements connected through each receiver are matched to other electrical elements by use of standard conductors having a predetermined impedance, and by securing the conductors in specific electrical configurations.

The housing interior is then potted with epoxy material to provide a strong but resilient protective covering for the impedance matching apparatus. By this means, the apparatus is made blast hard and the conductors are permitted some ability to slide and move rather than breaking in response to conditions of high mechanical tension, while the electrically connected elements are caused to remain in electrical contact.

It is, therefore, a primary object of the present invention to provide a blast-hardened apparatus and method for coupling two or more electrical elements.

Another object of the present invention is to provide a blast-hardened apparatus and method which also provides for blast-hardened connection between electrical elements so that continuous electrical contact is maintained therebetween, even during conditions when extreme forces are being applied to the apparatus.

A further object of the present invention is to provide a blast-hardened apparatus for matching impedance which also provides protection for interconnected systems or devices from the effects of exposure to high levels of electromagnetic pulse radiation.

Still another object of the present invention is to provide a blast-hardened apparatus for matching impedance of electrical elements which can interconnect, and match the impedances of, a multiplicity of electrical elements.

These and other objects and features of the present invention will become more fully apparent from the following description and appended claims taken in conjunction with the accompanying drawings.

DETAILED DESCRIPTION OF THE PREFERRED EMBODIMENTS

The invention is best understood by reference to the figures wherein like parts are designated with like numerals throughout.

Figure 1:
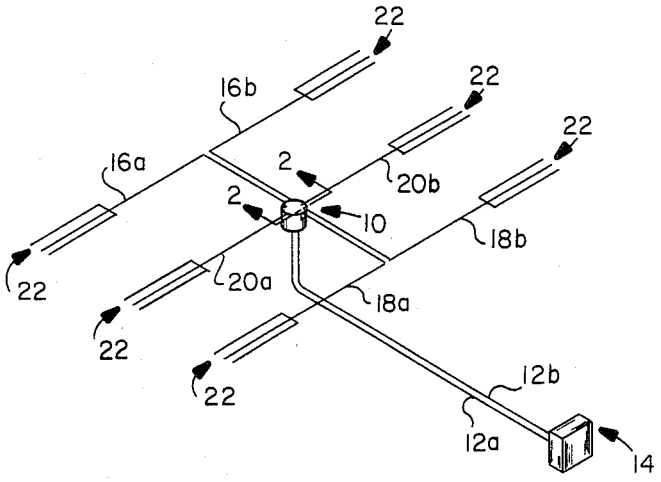
FIG. 1 is a perspective illustration of one presently preferred embodiment of the impedance matching device, depicting its use for interconnecting and matching the impedances of antenna elements in a communication system.

Referring initially to FIG. 1, one presently preferred embodiment of the impedance matching device (generally indicated at 10) is illustrated for purposes of explanation as it may be utilized in conjunction with an earth surface or buried antenna communication system. Of course, the impedance matching device finds application in conjunction with numerous other types of devices and systems as well.

In the embodiment of FIG. 1, the impedance matching device 10 is connected through two standard 50 ohm coax lines 12*a* and 12*b* to a transmitter/receiver 14 which comprises a conventional transmitter for sending electromagnetic signals and a conventional receiver for processing received electromagnetic signals. Transmitter/receiver 14 may be positioned below the surface of the ground (not shown) and it may be interconnected with other communication equipment (not shown), forming a communication system.

As will be described more fully hereafter, cables 12*a* and 12*b* each serve identical impedance matching circuitry positioned within different physical portions of the impedance matching device 10. Thus, elements of the impedance matching device and interconnected elements which are associated with the portion of the device connected to coaxial conductor 12*a* will be identified with the subscript "a". Likewise, those corresponding devices and elements associated with conductor 12*b* will be labeled with the subscript "b".

Each of the two sides of the impedance matching device 10 feed three interconnected antenna conducting arms 16*a*, 16*b*, 18*a*, 18*b*, 20*a* and 20*b*. It is noted that the conductor arms 16*a*, 18*a* and 20*a* each comprise one side of an antenna array, while arms 16*b*, 18*b* and 20*b* comprise respectively the other sides of the antenna array. Thus, the impedance matching device 10 of FIG. 1 serves six individual antenna conducting elements.

In the embodiment of the impedance matching device disclosed herein, if cables 12*a* and 12*b* are of the standard 50 ohm size, then proper impedance matching requires that conductors 16*a*, 16*b*, 18*a*, 18*b*, 20*a* and 20*b* each have an impedance value of approximately 300 ohms. These conductors are connected in parallel groups of three each with respect to their respective coaxial cables 12*a* and 12*b*, thus providing an effective impedance as seen from the cable connections of 100 ohms for each parallel combination. Thus, since the transmitter/receiver 14 sees 100 ohms of line-to-line impedance across coaxial cables 12*a* and 12*b* (since they have a common ground in device 10), the connections with cables 12*a* and 12*b* are, respectively, matched at the value of 100 ohms.

In addition, for proper phase maintenance of the system, it is important that the length of cables 12*a* and 12*b* be substantially the same, as should the lengths of each of the antenna conductors 16*a*, 16*b*, 18*a*, 18*b*, 20*a* and 20*b*. In the system illustrated in FIG. 1, antenna conductors 20*a* and 20*b* may be layed out to insure that the length of conductors 20*a* and 20*b* is substantially identical to the lengths of conductors 16*a*, 16*b*, 18*a* and 18*b*. If the lengths of these conductors vary, a shift in phase will result, producing an undesirable change in transmitted signal direction.

Optionally positioned at the end of each conductors 16*a*, 16*b*, 18*a*, 18*b*, 20*a* and 20*b* are tree terminations generally designated at 22. The tree terminations are connected to the antenna conductors by means of an electrical connector 24. In the communication system described herein, the electrical connector is also preferably blast-hardened. One particular type of blast-hardened electrical connector which has been shown to work well in this type of application is described in our copending patent application, U.S. Ser. No. 06/606,672, filed Feb. 17, 1984, and entitled "Hardened Electrical Connector," which is incorporated herein by reference.

Figure 2:
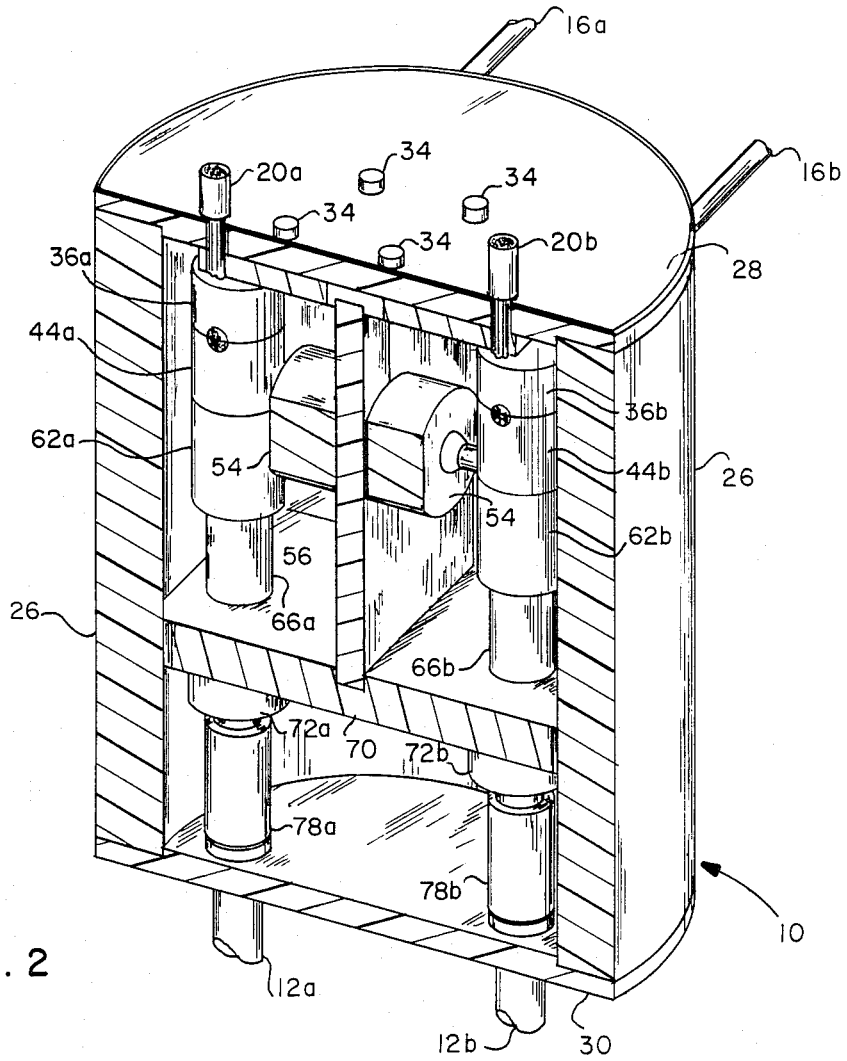
FIG. 2 is a cut away front perspective illustration of the embodiment of FIG. 1, taken along line 2—2 of FIG. 1.

Referring now to FIG. 2, the impedance matching device 10 includes a housing having substantially cylindrical walls 26 which, in the illustrated embodiment do not require shielding. The walls 26 are joined at their upper end to an electrically insulative top plate 28 and at their lower end to an electrically insulative bottom plate 30. The housing comprises the container within which the elements of the impedance matching device are confined. The housing also provides stability for the elements contained therein during the assembly process, and acts as a container for the epoxy material which is utilized to "pot" the device and thus to improve blast hardness.

Figure 3:
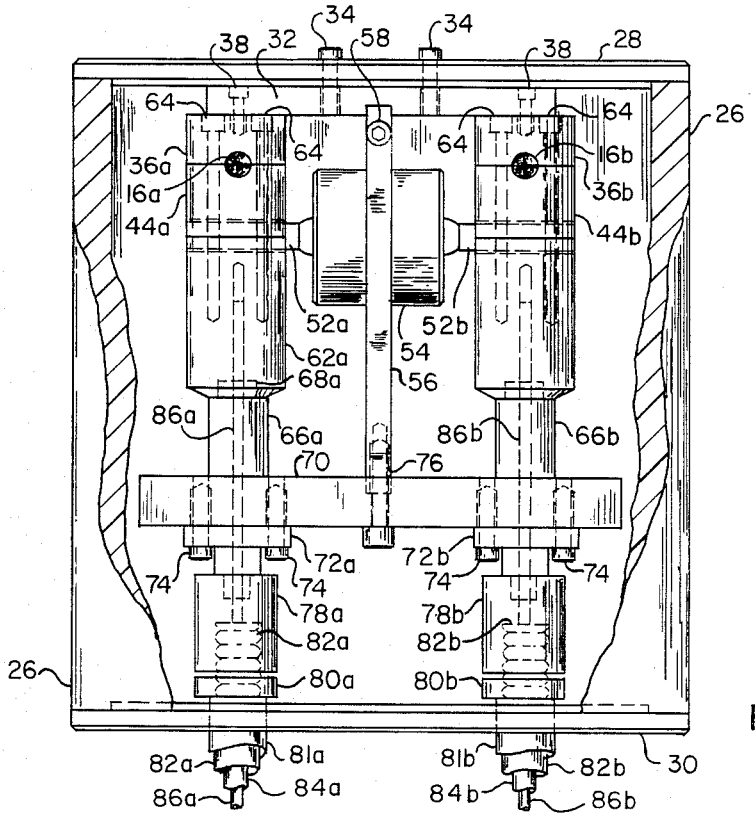
FIG. 3 is a cut away front elevational view of the embodiment of FIG. 1.

The particular elements of the impedance matching device may best be described by reference to FIGS. 3–6. Referring initially to FIG. 3, it may be seen that an electrically insulative tension plate 32 is secured adjacent the interior face of the housing top plate 28 by means of four socket-head cap screws 34 which extend through apertures in the body of top plate 28. Positioned upon the lower face of tension plate 32 and adjacent each of its outer ends are electrically conductive, substantially cylindrical, cap members 36*a* and 36*b*. Cap members 36*a* and 36*b* are positioned upon plate 32 so that their upper surfaces lie flush with the upper surface of tension plate 32, and are secured in position by socket-head cap screws 38 which extend through apertures in tension plate 32.

Figure 4:
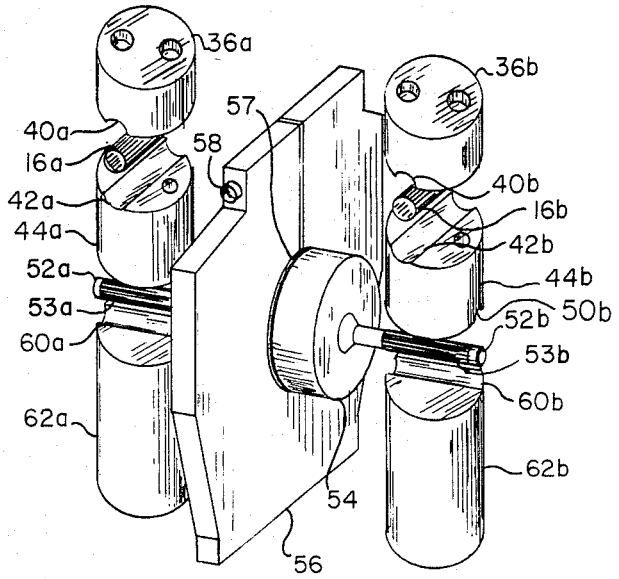
FIG. 4 is an exploded perspective view of the receivers and surge arrester of the embodiment of FIG. 3.

Referring now to FIG. 4 in addition to FIG. 3, concave channels 40*a* and 40*b* extend across the lower surface of each cap member 36*a* and 36*b*. Bare electrical conductors 16*a* and 16*b* are positioned so that at least their upper portions are received within channels 40*a* and 40*b*. The lower portions of conductors 16*a* and 16*b* are received and secured in position by additional channels 42*a* and 42*b*, which are positioned in the upper surface of conductive, substantially cylindrical spacers 44*a* and 44*b*. The top surfaces of spacers 44*a* and 44*b* are positioned adjacent the lower surfaces of cap members 36*a* and 36*b*, causing adjacent channels 40*a*, 40*b*, 42*a* and 42*b* to form conduits which receive and secure conductors 16*a* and 16*b* so as to provide positive electrical contact between the conductors and the walls of the conduit.

It is noted that the tension placed upon conductors 16*a* and 16*b* by the surrounding conduit is sufficient to securely retain them in fixed position under normal operating circumstances. However, conductors 16*a* and 16*b* are slideable within the conduit under conditions wherein the conductors 16*a* and 16*b* experience tensions having a force in excess of approximately 1,000 pounds tension.

Figure 6:
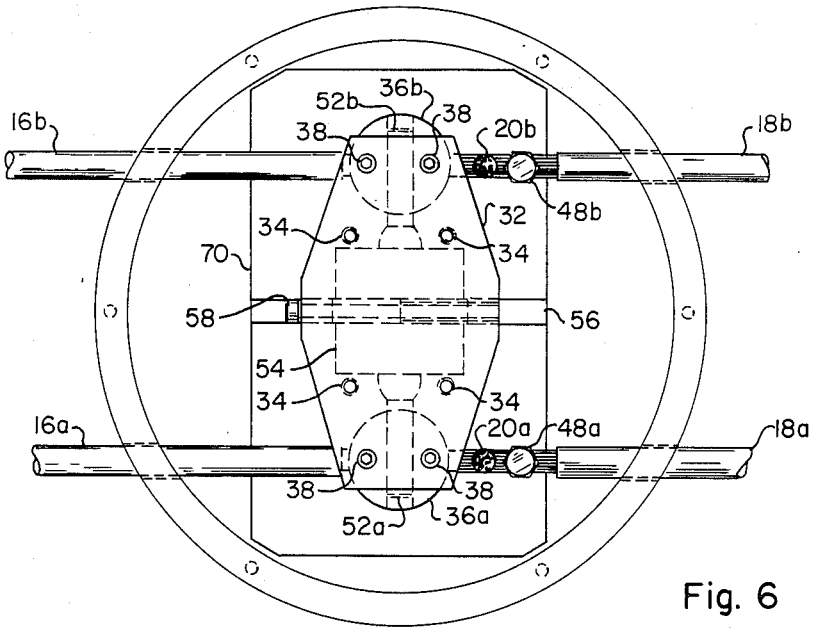
FIG. 6 is a top plan view of the embodiment of FIG. 1.
Figure 5:
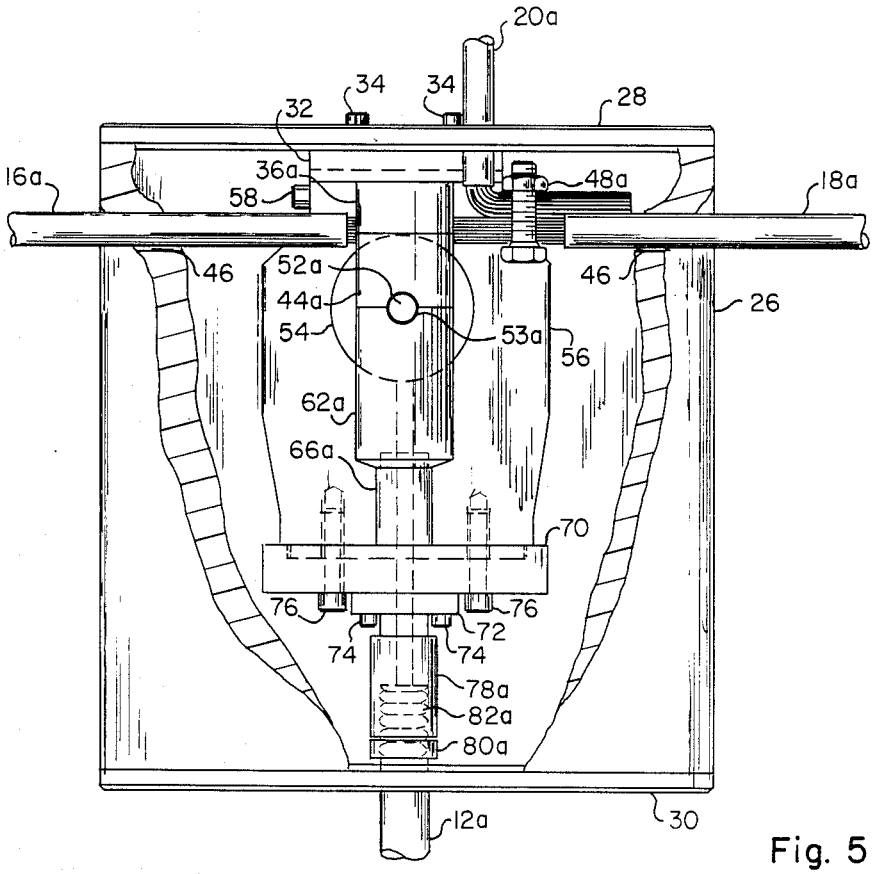
FIG. 5 is a cut away side elevational view of the embodiment of FIG. 1.

By reference to FIGS. 5 and 6, it may be seen that conductor 16*a* and conductor 18*a* actually comprise a single conductor, and likewise conductors 16*b* and 18*b* also comprise a single conductor. Each of conductors 16*a* and 18*a* or 16*b* and 18*b* comprise a conductor which is clamped at a position near its midsection as described above. The conductors have been designated 16*a* or 16*b* in FIGS. 5 and 6 based upon the fact that FIGS. 5 and 6 are looking at approximately the midpoint of the impedance matching device and in the direction of travel of conductors 16*a* or 16*b*. Conductors 16*a*, 16*b*, 18*a* and 18*b* extend outwardly from the impedance matching device through apertures 46 in the housing wall 26.

It will also be noted by reference to FIGS. 5 and 6 that the bared end portions of conductors 20*a* and 20*b* are secured to uninsulated portions of conductors 18*a* and 18*b*, respectively, by means of split bolt connectors 48*a* or 48*b*. The tension of connectors 48*a* and 48*b* may be adjusted so that conductors 20*a* and 20*b* are secured in fixed position adjacent conductor 18*a* or 18*b* under normal operating conditions, and so that conductors 20*a* and 20*b* are slideable with respect to conductors 18*a* or 18*b*, respectively, in response to tension forces on conductors 20*a* or 20*b* of predetermined magnitude, e.g., in excess of about 1,000 pounds. Conductors 20*a* and 20*b* extend outwardly from the impedance matching device through apertures in the housing top plate 28.

Referring again to FIG. 4, in conjunction with FIG. 3, it is seen that channels 50*a* and 50*b* extend from the inward side of each spacer 44*a* and 44*b* and at least partially across the lower surface thereof in a direction substantially perpendicular to that of associated channels 42*a* and 42*b*. Positioned within each channel 50*a* and 50*b* is a bushing 52*a* or 52*b*, each of which extends outward from opposite sides of an electrical surge arrester (ESA) 54. About the surface of each bushing 52*a* and 52*b* is positioned a layer of RF gasket material 53*a* and 53*b*, respectively, which increases the surface area which is brought into electrical contact between the bushings and the surface of channels 50*a* and 50*b*. ESA 54 may comprise any of a number of commercially available surge arresters, such as a Joslyn H3, part no. F5007-03.

ESA 54 extends through an aperture 55 in the central portion of a spacer clamp 56 which acts as a mechanical anchor to provide support for the ESA 54, and which also functions as an electrical ground. Positioned about the exterior surface of ESA 54 and adjacent the interior surfaces of the aperture 55 is a layer of R.F. gasket material 57 which is utilized to increase the surface area of electrical contact between the surface of ESA 54 and the adjacent surface of aperture 55.

Spacer clamp 56 is secured along its top end in a receiving slot which extends across the central, lower face of tension plate 32. Spacer clamp 56 is secured about ESA 54 by reducing the aperture size in spacer clamp 56 and tightening the tension upon the R.F. gasketing material 57 and ESA 54. The aperture size is reduced by means of a tension control nut 58 which, as it is tightened, serves to bring the opposing sides of spacer clamp 56 into tighter relationship.

The lower portion of each R.F. gasket covered bushing 52*a* and 52*b* of the ESA 54 is received within corresponding channel 60*a* or 60*b* which are positioned, respectively, in the top surface of receivers 62*a* and 62*b*. Channels 60*a* and 60*b* are the reverse image of channels 50*a* and 50*b*, respectively. Receivers 62*a* and 62*b* are secured along their top surface to the bottom surface of spacers 44*a* and 44*b* so that channels 60*a* and 50*a* as well as channels 60*b* and 50*b* define conduits which receive and secure the R.F. gasket cover bushings 52*a* and 52*b* in nesting relationship.

Referring particularly to FIG. 3, receivers 62*a* and 62*b*, spacers 44*a* and 44*b* and cap members 36*a* and 36*b* are fixed in position by means of socket head cap screws 64 which extend through aligned apertures in the cap members 36*a* and 36*b*, spacers 44*a* and 44*b*, and receivers 62*a* and 62*b*. Screws 64 are threaded into position by contact with threaded walls of the aligned apertures within each receiver 62*a* and 62*b*.

Insulator bushings 66*a* and 66*b*, which are constructed of material such as nylon, are each aligned against a lower end of one of corresponding receivers 62*a* or 62*b* by an annular boss 68*a* or 68*b* on the upper end of each bushing 66*a* or 66*b*. Each annular boss is received within a corresponding recess in the lower end of receiver 62*a* or 62*b*.

The lower portion of each bushing 66*a* and 66*b* passes through an aligned aperture in a conductive ground plate 70. The lower end of each bushing 66*a* and 66*b* is secured within the aperture in ground plate 70 in abutting contact with the base plate 72*a* or 72*b* of a conventional Andrew connector such that a central aperture in each base plate 72*a* and 72*b* is in alignment with the aperture in ground plate 70 and the associated bushing 66*a* or 66*b*. The base plates are secured in place by socket-head cap screws 74 which extend through the upper portion of the base plates 72*a* and 72*b* and are threaded within the body of ground plate 70. Ground plate 70 is secured in position both by its connection through bushings 66*a* and 66*b* to receivers 62*a* and 62*b*, and also by a connection to spacer clamp 56. Specifically, the bottom end of spacer clamp 56 is received in nesting relationship within an aligned slot in the upper surface of ground plate 70. A socket-head cap screw 76 extends through an aperture in the central portion of ground plate 70 and upward into the body of spacer clamp 56, where it is secured.

Directly connected to the base plates 72*a* and 72*b* and aligned with the apertures therein are female portions of the Andrew connectors, referred to herein as jacks 78*a* and 78*b*. The jacks 78*a* and 78*b* are oriented in a downward direction and are each configurated to receive the male portion of the Andrew connector, referred to herein as plug 80*a* or 80*b*. A plug 80*a* or 80*b* is secured to the forward end of each conductor shielding of cables 12*a* or 12*b*.

Coaxial cables 12*a* and 12*b* specifically comprise an outer insulators 81*a* and 81*b* comprised of material such as rubber, and outer shielding 82*a* and 82*b* which, in the present embodiment, are directly coupled through the Andrew connector to ground plate 70 and serve as the grounding means for the impedance matching device.

The coaxial cables 12*a* and 12*b* also each include an inner layer of insulation 84*a* and 84*b* which separates the outer shielding 82*a* and 82*b* from inner conductors 86*a* and 86*b*. Conductors 86*a* and 86*b* comprise a means for transmitting or receiving signals through the interconnected conductors 16*a*, 16*b*, 18*a*, 18*b*, 20*a* and 20*b*. At the forward ends of conductor 12*a* and 12*b* the insulation 81*a*, 81*b*, 84*a* and 84*b*, as well as the outer shielding 82*a* and 82*b* are removed so as to leave the inner conductors 86*a* and 86*b* extending several inches beyond the other conductor elements.

The forward end of each inner conductor 86*a* and 86*b* is terminated with a beryllium copper spring plug. Thus, the forward end of each of the inner conductors 86*a* and 86*b* is resiliently secured in a spread-apart configuration. The outer insulation 81*a* and 81*b* is removed even further so as to expose several inches of outer shielding 82*a* and 82*b*. The outer insulation 81*a* and 81*b* is then secured to its associated plug 80*a* and 80*b* so that the outer shielding 82*a* and 82*b* and the inner layers of insulation 84*a* and 84*b* extend beyond the forward end of the plug, with the inner conductors 86*a* and 86*b* extending well beyond the forward end of the plug and the other conductors and insulation.

The cables 12*a* and 12*b* are electrically connected and secured to the impedance matching device by securing the plugs 80*a* and 80*b* within the jacks 78*a* and 78*b* in the conventional manner. With the plugs secured within the jacks, the outer conductor 82*a* extends within and is maintained in physical contact with the inner walls of the aperture in the jacks. Because of their flexibility, the outer conductors may be tightly secured to the plugs. When high tension forces are applied to the insulation, as in the case of shock waves in the earth, the insulation merely responds by stretching without breaking. Further, the outer shielding 82*a* and 82*b* is corrugated along its length and thus extendable in an axial direction in response to tension induced by shock waves or ground displacement. In addition, since the outer insulation is secured to the plug, the outer shielding is not rigidly secured to any structure and is free to slide longitudinally within the insulation and within the jack 78*a* or 78*b* in response to displacement forces while still retaining electrical contact with the inner walls of the jack.

With the plug secured to the jack as described above, the spread-apart forward plug end of each inner conductor 86*a* and 86*b* extends upward through the apertures in the plugs 80*a* and 80*b*, the jacks 78*a* and 78*b* and the bases 72*a* and 72*b*, and through the bushings 66*a* and 66*b*, and extends for at least two inches into a chamber in the central portion of each receiver 62*a* and 62*b*. Because the forward ends of inner conductors 86*a* and 86*b* are spring plugs in a resilient manner, they contact and apply pressure to the walls of the chamber in receivers 62*a* and 62*b*. Thus, the inner conductors 86*a* and 86*b* are securely received and retained within receivers 62*a* and 62*b*. However, as with conductors 16*a*, 16*b*, 18*a*, 18*b*, 20*a* and 20*b*, conductors 86*a* and 86*b* are slideable within receivers 62*a* and 62*b* in response to tensions applied to conductors 86*a* and 86*b*.

It is apparent from the foregoing that the assembled receivers 36, 44 and 62 comprise terminals configured to match the impedance of the shielded transmission lines 12. With the assembly constructed as described above, the bare portions of conductors 16*a*, 16*b*, 18*a*, 18*b*, 20*a* and 20*b* are coated with one of the many commercially available silicone rubber compounds used for sealing and protecting electrical conductors. One such compound is known by the trademark "RTV", and is manufactured by the General Electric Company. The RTV compound acts as an insulation around the conductors, and permits the conductor to be slideable therein to substantially the same extent as the standard electrical insulation which surrounds those portions of the conductors which have not been made bare.

With the components of the impedance matching device assembled, and with the conductors coated and protected with RTV, the device is "potted" by placing resinous material within the interior of the housing defined by housing walls 26, top plate 28 and bottom plate 30. As a result of the potting process, the components are rigidly retained in position and are protected from the effects of close-in explosions, or natural phenomena. Specifically, the resinous material hardens to form a very strong, but resilient shield material for surrounding the sensitive and important components of the impedance matching device.

After potting, each of the conductors within the housing remains slideable to the extent described above since the RTV compound, as well as the other connectors and components through which the conductors permit such slideability and also serve to extend, prevent contact between the conductors and the resinous material.

As was previously described, in operation with two standard 50 ohm coaxial cables 12*a* and 12*b*, each connected on separate sides of the impedance matching device to a parallel configuration of three 300 ohm conductors, a balanced impedance is produced. In this situation, a transmitter connected to coaxial cables 12*a* and 12*b* sees a line to line impedance of 100 ohms, and this matches the 100 ohm impedance seen on each to the interconnected arrays on the separate sides of the impedance matching device.

One skilled in the art will recognize that the use of this type of system would require either a transmitter/-receiver which is built to operate into a balanced 100 ohm line, or the use of a transmission line transformer which would match the transmitter/receiver to the 100 ohm line. Of course, in producing a militarily hard system, the transmission line transformer would necessarily have to be shielded against the effects of electromagnetic pulse radiation, and also would need to be protected against shock waves and the like. This could be accomplished by simply potting the transmission line transformer and providing slideable connections in the manner described above.

Another option for providing a balanced system which is usable with a standard 50 ohm transmitter/-receiver would be to provide two separate impedance matching devices of the type described above, connecting two separate systems, and then to connect the center conductors 86*a* and 86*b* of one impedance matching device with the corresponding center conductors of the other impedance matching device.

In each of the alternate embodiments described for interconnecting the impedance matching devices, it is recognized that the same structure as described above would be utilized to provide hardness for the system.

During operation of the system under extreme ground-displacement conditions, the impedance matching device functions to both provide protection from electromagnetic pulse radiation, and also to maintain continued electrical contact between the interconnected components. Specifically, the impedance matching device 10 provides protection from electromagnetic pulse radiation as a result of the presence of the electrical surge arrester 54.

In typical operating conditions, the electrical surge arrester 54 is set to function in response to voltage/current levels on one of the coaxial cables significantly above normal power transmission levels. Upon the occurrence of voltages/currents in excess of that magnitude, an electrical connection is completed between the bushings 52*a* and 52*b* and the spacer clamp 56, which is connected to ground plate 70. Thus, in response to excessively high voltages/currents, both sides fo the surge arrester short to ground via spacer clamp 56.

In response to large displacements of the earth or of other tensions experienced by the conductors 16*a*, 16*b*, 18*a*, 18*b*, 20*a* and 20*b*, or the cables 12*a* and 12*b*, the device provides the means whereby the conductors may slide with respect to their point of connection, without losing electrical contact. For use of the impedance matching device in applications of the type described herein, conductors capable of maintaining electrical contact while sliding a distance of approximately 2 inches should generally be sufficient for blast hardness under presently expected emergency conditions. Of course, this number varies depending upon the length of the conductor and the amount of ground movement.

In addition to accomplishing the above purposes, the individual components of the impedance matching device itself are protected by the potting material which surrounds them, securing those components in position and providing very strong protection for them from outside forces.

From the foregoing description it will be appreciated that the novel, hardened impedance matching device disclosed herein clearly overcomes many of the long-standing problems in the art by (1) providing a blast-hardened device and method for effectively and easily matching the impedance of two systems or devices which are to be connected; (2) providing such a device which additionally provides for blast-hardened connections which maintain continuous electrical contact between interconnected systems and devices, even in the presence of extreme forces; (3) providing a blast-hardened apparatus for matching impedance which addtionally provides reliable protection for the interconnected systems or devices from the effects of exposure to electromagnetic pulse radiation; and (4) providing such a device which includes the capability of interconnecting multiple systems or devices in a blast-hardened arrangement.

The invention may be embodied in other specific forms without departing from its spirit or essential characteristics. The described embodiment is to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and described to be secured by United States Letters Patent is:

1. An apparatus for connecting a plurality of antenna conducting arms adapted for receiving and radiating electromagnetic energy comprising:

first means for slideably securing within a housing a portion of a first electrical antenna conducting arm;

second means for slideably securing within the housing a portion of a second electrical antenna conducting arm; and means electrically coupling the first and second securing means such that the electrical connection is maintained even when the antenna conducting arms are subjected to displacement.

2. An apparatus as defined in claim 1 wherein at least one of said conducting arms is shielded and wherein said shielding is mounted to permit slideable electrical connection of the shielding.

3. An apparatus as defined in claim 1, further comprising means for detecting and responding to excessive current loading on the conducting arms, thereby protecting the conducting arms from damage due to the excessive current loading.

4. An apparatus as defined in claim 1, further comprising resinous material within the housing and surrounding the securing means for securing components in position, and for protecting said components from extreme forces.

5. An apparatus for matching impedances of electrical elements of an antenna assembly comprising:

means for radiating electromagnetic energy, said means comprising an electrical conducting arm having a known impedance;

an electrical conductor means comprising a cable having a known impedance for connecting the radiating means to a transceiver;

said conducting arm and cable being configured to match the impedance of one with respect to the other; and terminal means for electrically coupling the cable in slideable relation such that longitudinal displacement of either will not electrically separate the conducting arm and cable.

6. An apparatus for matching impedances as defined in claim 5, further comprising a housing circumscribing the terminal means and confining the terminal means in a resinous material.

7. An apparatus for matching impedances as defined in claim 5 wherein said electromagnetic radiating means comprises a two component array of antenna conductors, the first component array being joined together electrically at a first terminal and the second component array being electrically joined together at a second terminal.

8. An apparatus for matching impedances as defined in claim 7 wherein said first and second terminals are connected to an electrical surge arrester for shortng current surges to ground.

9. An apparatus for matching impedances as defined in claim 7 wherein said antenna array is configured to match the impedance of the cable at the corresponding terminal.

10. An apparatus as defined in claim 7 wherein said cable is configured to match the impedance of the corresponding antenna array at the terminal means.

11. Protection apparatus for matching impedances of and electrically connecting electrical elements of an antenna assembly comprising:

a housing;

means within the housing for slideably securing in electrical contact at least one first electrical conductor defining a first impedance and at least one second electrical conductor defining a second impedance, wherein the first and second impedances are substantially matched;

means within the housing for slideably securing in electrical contact at least one third electrical conductor defining a third impedance and at least one fourth electrical conductor defining a fourth impedance, wherein the third and fourth impedances are substantially matched; and means within the housing and electrically conductable to the conductors for protecting the electrical conductors and electrical elements from excessive voltage and current loading.

12. Protection apparatus for matching impedances as defined in claim 11 wherein the circuits defined by the first and second impedance and the circuits defined by the third and fourth impedance are connected to a common grounding means.

13. Protection apparatus for matching impedances as defined in claim 11 wherein the first and third conductors comprise coaxial cables.

14. Protection apparatus for matching impedances as defined in claim 11 wherein both said securing means are immersed in cured resinous material to both electrically insulate and mechanically strengthen the apparatus.

15. Protection apparatus for matching impedances of and electrically connecting electrical elements of a buried antenna assembly comprising:

a housing;

a first plurality of conducting arms of an antenna array for radiating electromagnetic radiation;

a first coupling terminal within the housing to which the conducting arms of the first antenna array are mounted so as to permit displacement with respect thereto and said conducting arms being connected to define a first impedance;

a second plurality of conducting arms of an antenna array for radiating electromagnetic radiation, said second array being complimentary to said first array;

a second coupling terminal within the housing to which the conducting arms of the second antenna array are mounted so as to permit displacement with respect thereto, said conducting arms being connected to define a second impedance and wherein said first and second impedances are made to be substantially the same;

means within the housing for securing at least two coaxial cables connected in parallel configuration between a transmitter/receiver and the protection apparatus, and wherein the coaxial cables are each characterized by an impedance which substantially equals the first impedance and the second impedance;

a retainer for securing one of the coaxial cables in electrical connection with the first coupling terminal, thereby forming a substantially matched impedance across the electrical connection, said retainer permitting axial displacement of the coaxial cable without breaking electrical conduit; and a retainer for securing the other coaxial cable in electrical connection with the second coupling trminal, forming a substantially matched impedance across the electrical connection, said retainer permitting axial displacement of the coaxial cable without breaking electrical contact;

an electrical surge arrester connected to the coupling terminals for protecting the electrical elements from effects of electromagnetic pulse radiation.

16. Protection apparatus for matching impedance as defined in claim 15 wherein the housing is substantially filled with resinous potting material.

17. A method for matching impedances of and electrically connecting together a feed cable and a plurality of antenna conducting arms in a protected environment, the method comprising the steps of:

determining the impedance of a first electrical conducting arm;

selecting a feed cable and connecting said cable and said conducting arm so as to match the impedance of said conducting arm to said cable; and said connecting step comprising slideably mounting each conducting arm and said cable within a terminal such that limited longitudinal displacement of the conducting arms or cable will not separate the conducting arms and cable from electrical contact with one another.

18. A method for matching impedances as defined in claim 17 wherein said connecting step comprises mounting the conducting arms and cables in a connecting terminal.

19. A method for matching impedances as defined in claim 18, further comprising coupling the conducting terminal to an electrical surge arrester.

20. A method for matching impedances as defined in claim 18 further comprising the steps of immersing at least the terminal in impact-resistant resinous material.

21. A method for matching the impedances of radiating conductor arms of an antenna assembly with a corresponding electrical transmission line, comprising the steps of:

ascertaining the impedance of the transmission line;

connecting the radiating conductor arms of the antenna assembly to a terminal such that the impedance of the radiating conductor arms at the terminal is matched to the transmission line, said connecting step comprising:

exposing a length of each radiating conductor arm to the terminal;

mounting the exposed length upon the terminal and exerting physical force therebetween such that electrical contact exists; and controlling said physical force such that each radiating conductor arm is displaceable relative to the terminal under impact forces without breaking electrical contact between the conductor arms and transmission line.

22. A method for matching impedances as defined in claim 21, further comprising the step of connecting the transmission line to the terminal with a slideable coupling.

23. A method for matching impedances as defined in claim 22 wherein said connecting step comprises inserting an elongated center conductor arm into an interior bore of the terminal and selecting the diameter of the center conductor arm so as to be displaceable within the bore of the terminal without breaking electrical contact with said terminal.

24. A method for matching impedances as defined in claim 21 further comprising surrounding the terminal with impact-resistant resinous material.

25. A method for matching impedances of and electrically connecting electrical elements of an antenna comprising:

slideably securing within a housing, in electrical contact, at least one first conductor defining a first impedance and at least one second conductor defining a second impedance, wherein the first and second impedances are substantially matched;

slideably securing within the housing, an electrical contact, at least one third electrical conductor defining a third impedance and at least one fourth electrical conductor defining a fourth impedance, wherein the third and fourth impedances are substantially matched; and protecting the electrical conductors and electrical elements from excessive current loading by use of protective means positioned within the housing.

26. A method for matching impedances as defined in claim 25 further comprising the step of electrically isolating, during normal operation, electrical circuits defined by the connected first and second impedances from electrical circuits defined by the connected third and fourth impedances.

27. A method for matching impedances as defined in claim 26 further comprising the step of connecting circuits defined by the first, second, third and fourth impedances to a common grounding means.

28. A method for matching impedances as defined in claim 25 further comprising the step of fixing positions, relative to the housing, of insulation surrounding portions of the conductors.

29. A method for matching impedances as defined in claim 25 further comprising the step of coating, with an insulation material, those portions of the conductors within the housing which are bare and free from physical contact with other components in the housing.

30. A method for matching impedances of radiating conductors of an antenna assembly with corresponding transmission lines, comprising the steps of:

ascertaining the impedance of each transmission line;

configuring a plurality of radiating conductors of the antenna assembly into complementary arrays and electrically connecting the arrays to discreet terminals corresponding in number to the number of transmission lines, said configuring and connecting steps being performed so as to match the impedances of each array with its corresponding transmission line at the terminal;

mounting the antenna array in the terminal so as to permit displacement between the terminal and the radiating conductors without breaking electrical contact;

attaching the corresponding transmission line to the terminal so as to permit displacement between the terminal and the radiating conductors without breaking electrical contact;

connecting each terminal to an electrical surge arrester to protect conductors from overloading; and surrounding the terminals with impact-resistant materials.

* * * * *

UNITED STATES PATENT AND TRADEMARK OFFICE

CERTIFICATE OF CORRECTION

PATENT NO. : 4,755,824

DATED : July 5, 1988

INVENTOR(S) : Stuart Biddulph et al.

It is certified that error appears in the above-identified patent and that said Letters Patent is hereby corrected as shown below:

Column 5, line 57, "each conductors" should be --each conductor--

Column 10, line 51, "fo" should be --of--

Column 12, line 4, "coupling the cable" should be --coupling the conducting arm and cable--

Column 12, line 21, "shortng" should be --shorting--

Column 13, line 31, "trminal" should be --terminal--

Column 15, line 7, "discreet" should be --discrete--

Signed and Sealed this

Fourteenth Day of March, 1989

*Attest:*

*Attesting Officer*

DONALD J. QUIGG

*Commissioner of Patents and Trademarks*